US005883862A

United States Patent [19]

Wang

[11] Patent Number: 5,883,862

[45] Date of Patent: Mar. 16, 1999

[54] CLOCK HAVING EMERGENCY LIGHTING DEVICE

[76] Inventor: Shui-Ho Wang, 81-18, Lia Hai Road, Ching Swei Township, Taichung Hsien, Taiwan

[21] Appl. No.: 90,319

[22] Filed: Jun. 4, 1998

[51] Int. Cl.[6] ..... G04B 47/00; G04B 19/30

[52] U.S. Cl. ..... 368/10; 368/67; 368/227

[58] Field of Search ..... 368/66, 67, 68, 368/227, 256

[56] References Cited

U.S. PATENT DOCUMENTS

| | | | |
|---|---|---|---|
| 3,899,871 | 8/1975 | Kitai | 368/227 |
| 4,611,200 | 9/1986 | Stilwell | 368/11 |
| 4,949,077 | 8/1990 | Mbuthia | 368/11 |
| 4,972,394 | 11/1990 | DiMarco | 368/227 |
| 5,012,507 | 4/1991 | Leighton | 379/73 |

*Primary Examiner*—Bernard Roskoski
*Attorney, Agent, or Firm*—Bacon & Thomas, PLLC

[57] ABSTRACT

A clock is provided with an emergency lighting device which is composed of an electronic control apparatus, at least one light bulb, a battery, a plug, and a switch knob. The light bulb is located in a concave slot of the dial plate of the clock such that light bulb does not obstruct the movements of the second hand, the minute hand and the hour hand of the clock. The emergency lighting device is housed in the case of the clock. When a power outage takes place, the electronic control apparatus is triggered to turn on the light bulb.

2 Claims, 3 Drawing Sheets

CLOCK HAVING EMERGENCY LIGHTING DEVICE

FIELD OF THE INVENTION

The present invention relates generally to a clock, and more particularly to a clock having an emergency lighting device.

BACKGROUND OF THE INVENTION

The conventional clocks are not provided with an emergency lighting device, which can be used to illuminate the clock as well as the room in which the clock is located, at the time when the power outage takes place.

SUMMARY OF THE INVENTION

The primary objective of the present invention is to provide a clock with an emergency lighting device. The clock comprises a case which is provided with a plurality of socket slots for receiving light bulbs. The socket slots are concave in construction such that the light bulbs do not obstruct the movements of second hand, minute hand and hour hand of the clock. An electronic control device is housed in the case frame for controlling the ON-OFF switching of the power to the light bulbs.

The foregoing objective, features, and functions of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
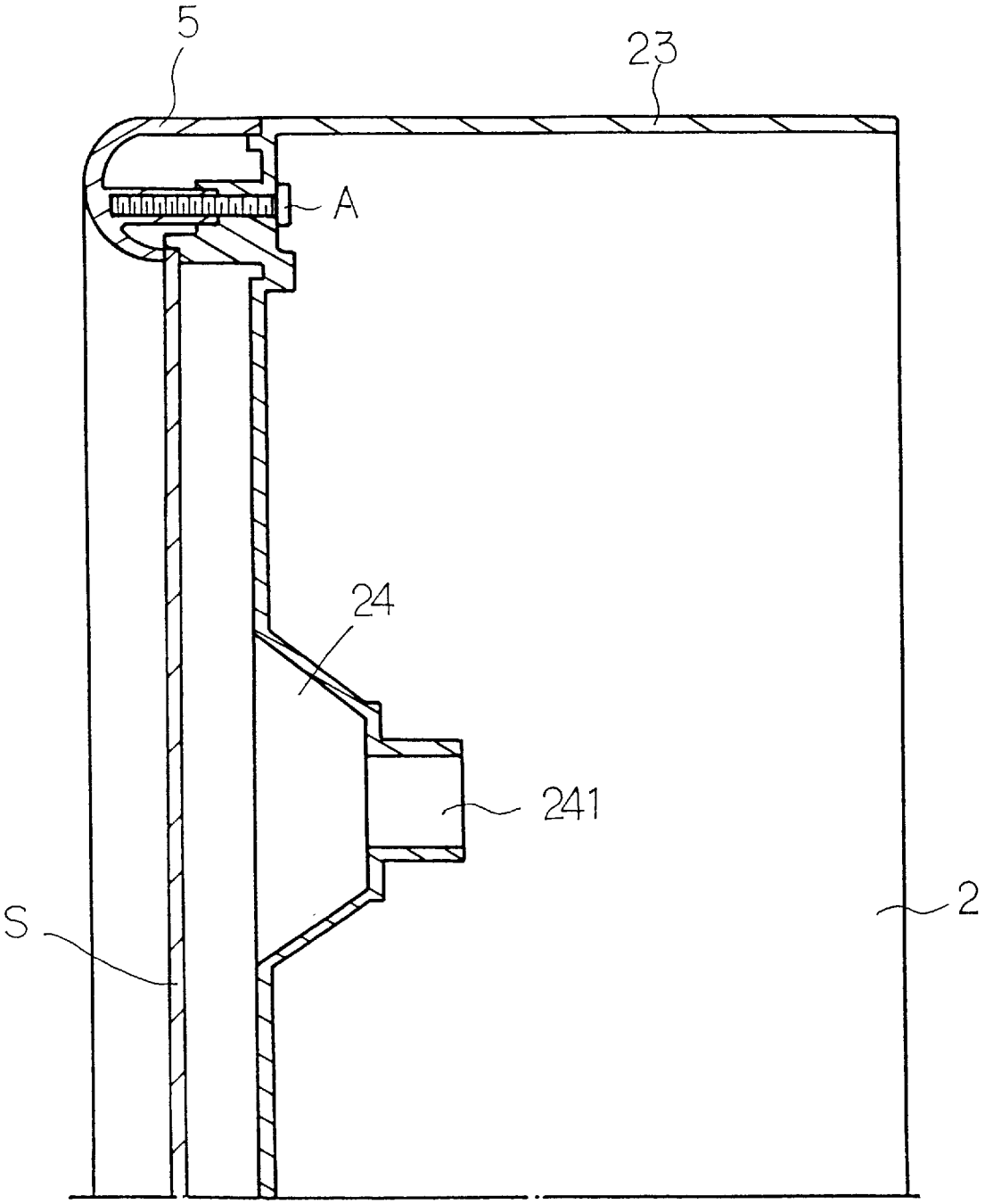
FIG. 1 shows a partial sectional view of a case of a clock of the present invention.
Figure 2:
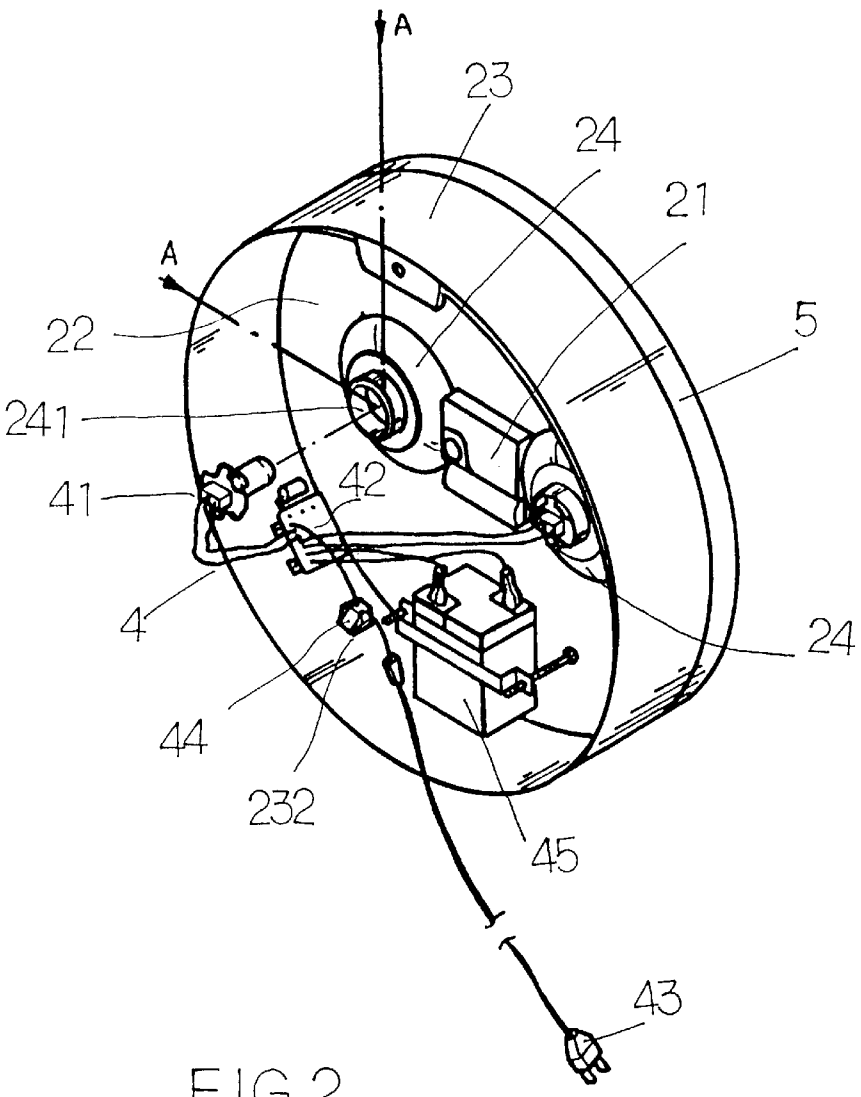
FIG. 2 shows a partial exploded view of the present invention.
Figure 3:
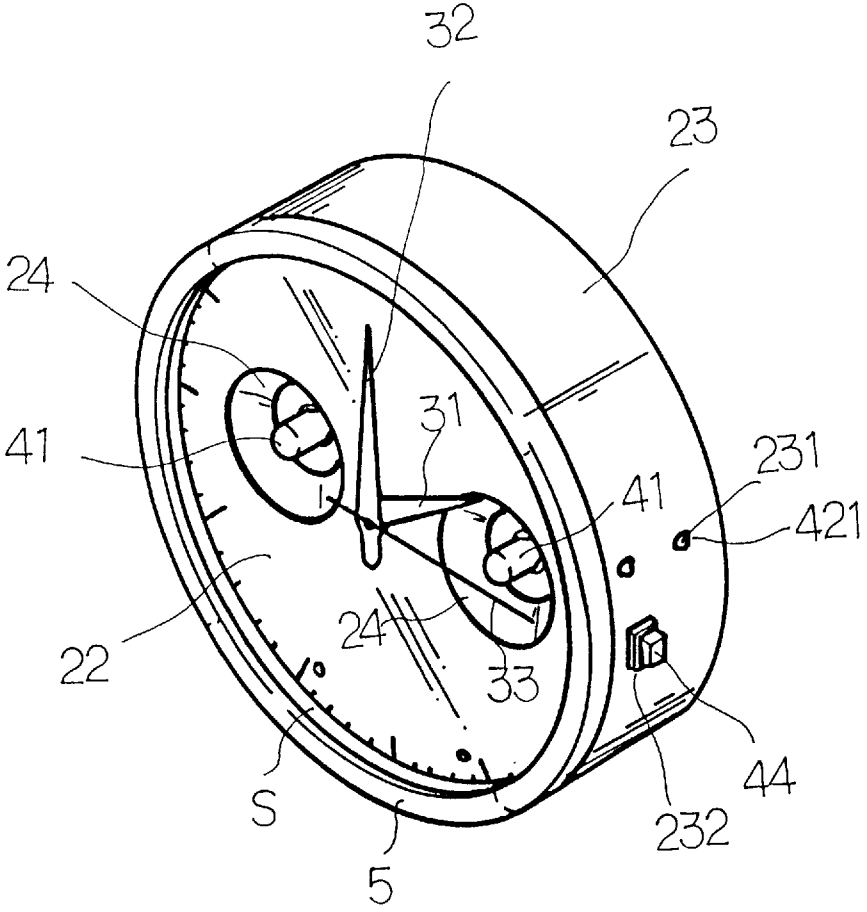
FIG. 3 shows a perspective view of the present invention in combination.

As shown in FIGS. 1–3, a clock embodied in the present invention consists of a case 2, a machine core 21 for controlling the operation of an hour hand 31, a minute hand 32 and a second hand 33, and an emergency lighting device 4.

The case 2 has a dial plate 22 and a case frame 23. The dial plate 22 is provided with a plurality of socket slots 24 each having an insertion hole 241. The case frame 23 is provided with a plurality of naked holes 231 and a through slot 232. The dial plate 22 is covered by a shield 5 of a transparent material S, such as glass. The shield 5 is fastened with the dial plate 22 by a fastening bolt A, as shown in FIG. 1.

The lighting device 4 is housed in the case 2 and composed of a plurality of light bulbs 41, an electronic control apparatus 42, a plug 43, a switch knob 44, and a battery 45. The light bulbs 41 are fitted into the insertion holes 241 of the socket slots 24. The electronic control apparatus 42 is connected with the light bulbs 41, the plug 43, the switch knob 44 and the battery 45. The electronic control apparatus 42 has an indication light bulb 421, which is received in the naked hole 231 of the case frame 23. The switch knob 44 is received in the through slot 232 of the case frame 23 such that the switch knob 44 is exposed. The light bulbs 41 can be periodically tested by pressing the switch knob 44 to see if the light bulbs 41 are still in a good working condition.

Whenever the power outage takes place, the electronic control apparatus 42 is automatically triggered such that the light bulbs 41 emit light. As soon as the power supply is restored via the plug 43, the power supply of the battery 45 is cut off immediately by the electronic control apparatus 42.

The embodiment of the present invention described above is to be deemed in all respects as being illustrative and not restrictive. Accordingly, the present invention may be embodied in other specific forms without deviating from the spirit thereof. The present invention is therefore to be limited only by the scope of the following appended claim.

What is claimed is:

1. A clock having an emergency lighting device, said clock comprising:

a case having a dial plate and a case frame, said dial plate provided with at least one socket slot having an insertion hole, said dial plate further provided with a transparent shield fastened therewith, said case frame provided with at least one naked hole and a through slot; and a lighting device housed in said case and composed of at least one light bulb fitted into said insertion hole of said socket slot of said dial plate of said case, a plug, a switch knob located in said through slot of said case frame, a battery, and an electronic control apparatus connected with said light bulb, said plug, said switch knob and said battery, said light bulb capable of being triggered by said electronic control apparatus to emit light at such time when a power outage takes place.

2. The clock as defined in claim 1, wherein said electronic control apparatus has an indication light bulb which is received in said naked hole of said case frame of said case.

* * * * *